US006903514B2

(12) United States Patent
Yun et al.

(10) Patent No.: US 6,903,514 B2
(45) Date of Patent: Jun. 7, 2005

(54) ERASING METHOD AND APPARATUS FOR PLASMA DISPLAY PANEL

(75) Inventors: Sang Jin Yun, Pohang-shi (KR); Seong Ho Kang, Daegu (KR); Moon Shick Chung, Kumi-shi (KR); Chang Hwan Koo, Daegu (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 10/449,490

(22) Filed: Jun. 2, 2003

(65) Prior Publication Data

US 2003/0222863 A1 Dec. 4, 2003

(30) Foreign Application Priority Data

Jun. 3, 2002 (KR) ..... P10-2002-0031133
Jul. 3, 2002 (KR) ..... P10-2002-0038264

(51) Int. Cl.[7] ..... G09G 3/10
(52) U.S. Cl. ..... 315/169.4; 345/208; 345/60

(58) Field of Search ..... 315/169.4, 167, 315/160; 345/204, 208, 37, 41–42, 60

(56) References Cited

U.S. PATENT DOCUMENTS 5,656,893 A * 8/1997 Shino et al. ..... 315/169.4
5,663,741 A * 9/1997 Kanazawa ..... 345/66
6,118,220 A * 9/2000 Shino et al. ..... 315/169.4
6,559,816 B1 * 5/2003 Koo et al. ..... 345/60
6,653,795 B2 * 11/2003 Kang et al. ..... 315/169.3

* cited by examiner

*Primary Examiner*—Thuy Vinh Tran
(74) *Attorney, Agent, or Firm*—Fleshner & Kim, LLP

(57) ABSTRACT

An erasing method and apparatus for a plasma display panel that is capable of minimizing spurious wall charges left after an erasing discharge. In the erasing method, an erasing signal taking a ramp waveform shape is applied to any one of first and second electrodes for alternately causing a sustain discharge. A voltage of said erasing signal is sustained at a voltage upon erasing discharge after the erasing discharge caused by said erasing signal.

30 Claims, 8 Drawing Sheets

ERASING METHOD AND APPARATUS FOR PLASMA DISPLAY PANEL

BACKGROUND OF THE INVENTION

1. Field of the Invention

This invention relates to a plasma display panel, and more particularly to an erasing method and apparatus that is capable of minimizing spurious wall charges left after an erasing discharge.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a scan electrode Y, a sustain electrode Z, and an address electrode X intersecting the scan electrode Y and the sustain electrode Z.

Each intersection among the scan electrode Y, the sustain electrode Z and the address electrode X is provided with a cell 1 for displaying any one of red, green and blue colors. The scan electrode Y and the sustain electrode Z is provided on an upper substrate (not shown). A dielectric layer and an MgO protective layer (not shown) are disposed on the upper substrate. The address electrode X is provided on a lower substrate (not shown) . On the upper substrate is provided a barrier rib for preventing optical and electrical interference between horizontally adjacent cells. On the lower substrate and the surface of the barrier rib is provided a phosphorus material excited by a vacuum ultraviolet ray UV to emit a visible light. An inactive mixture gas such as He+Xe, Ne+Xe or He+Ne+Xe is injected into a discharge space between the upper substrate and the lower substrate.

Such a three-electrode AC surface-discharge PDP makes a time-divisional driving of one frame, which is divided into various sub-fields having a different emission frequency, so as to realize gray levels of a picture. Each sub-field is again divided into an initialization period for initializing the entire field, an address period for selecting the scan line and selecting the cell from the selected scan line and a sustain period for expressing gray levels depending on the discharge frequency. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the conventional PDP applied to the sub-fields.

Referring to FIG. 3, the PDP is divided into an initialization period for initializing the full field, an address period for selecting a cell, and a sustain period for sustaining a discharge of the selected cell for its driving.

In the initialization period, a ramp-up waveform is simultaneously applied all the scan electrodes Y in a set-up interval SU. A discharge is generated within the cells at the full field with the aid of the ramp-up waveform. By this set-up discharge, positive wall charges are accumulated onto the address electrode X and the sustain electrode Z while negative wall charges are accumulated onto the scan electrode Y. In a set-down interval SD, a ramp-down waveform falling from a positive voltage lower than a peak voltage of the ramp-up waveform is simultaneously applied to the scan electrodes Y after the ramp-up waveform was applied. The ramp-down waveform causes a weak erasing discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge. Meanwhile, a positive direct current voltage Zdc is applied to the sustain electrodes Z during the set-down interval and the address period.

In the sustain period, a sustaining pulse sus is alternately applied to scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied. The sustain pulse sus has a pulse width of about 2 to 3 $\mu$s for the sake of a stable discharge and keeps a sustain voltage Vs of about 180 to 200 volts. A discharge is caused within about 0.3 to 1.0 $\mu$s after a time at which the sustain pulse sus was generated. Thereafter, wall charges enough to cause the next discharge are formed with the cell in a time interval when the sustain voltage Vs is sustained.

After termination of the sustain discharge, an erasing signal for erasing space charges and wall charges formed by the sustain discharge is applied to the scan electrode Y and the sustain electrode Z. A fine-width erasing pulse rect-ers taking a rectangular waveform as shown in FIG. 4 or an erasing waveform taking a ramp shape (hereinafter referred to as "ramp erasing waveform) as shown in FIG. 5A and FIG. 5B is mainly used as the erasing signal. The fine-width erasing pulse rect-ers or the ramp erasing pulse ramp-ers is applied to an electrode opposed to any electrode supplied with the last sustain pulse sus of the scan electrode Y and the sustain electrode Z alternately supplied with the sustain pulse. In other words, the fine-width erasing pulse rect-ers or the ramp erasing waveform ramp-ers is applied to the sustain electrode Z when the last sustain pulse sus is applied to the scan electrode Y; whereas they is applied to the scan electrode Y when the last sustain pulse sus is applied to the sustain electrode Z.

However, the fine-width erasing pulse rect-ers or the ramp erasing waveform ramp-ers applied currently raises a problem in that a discharge characteristic deviation is not considered, or additional wall charges are generated due to a voltage applied after the erasing discharge to be left within the cell.

More specifically, the fine-width erasing pulse rect-ers taking a rectangular waveform keeps a sustain voltage Vs during a pulse width interval within approximately 1 μs as shown in FIG. 4. However, the cells of the PDP have some difference in a discharge delay characteristic because physical and electrical deviations within the cells exist. For this reason, if the fine-width erasing pulse rect-ers taking a rectangular waveform is applied to the scan electrodes Y or the sustain electrodes Z of the entire cells, then an erasing discharge is generated at the cell having a short discharge delay; whereas an erasing discharge is not generated at the cell having a long discharge delay more than approximately 1 μs. At the cells having not generated the erasing discharge, wall charges generated by the sustain discharge are left as they are to make an affect to the next sub-field.

On the other hand, the ramp erasing pulse ramp-ers has a rising edge rising from 0V or a ground voltage GND until a sustain voltage Vs which is equal to a value of approximately 5 μs and has a time interval sustaining the sustain voltage Vs which is equal to a value of approximately 3 μs, as shown in FIG. 5A. A majority of cells causes an erasing discharge during a voltage-rising interval as shown in FIG. 5B. However, since the sustain voltage Vs is relatively high and the sustaining interval thereof is relatively long, space charges within the cell are changed into wall charges after the erasing discharge and accumulated onto a dielectric material within the cell. The wall charges generated after the erasing discharge make an affect to the next sub-field. Herein, FIG. 5A depicts a ramp erasing waveform ramp-ers when the erasing discharge does not occur, and FIG. 5B shows a voltage drop 51 of the ramp erasing pulse ramp-ers caused by a discharge current generated at a position where the erasing discharge occurs.

SUMMARY OF THE INVENTION

Accordingly, it is an object of the present invention to provide an erasing method and apparatus for a plasma display panel that is capable of minimizing spurious wall charges left after an erasing discharge.

In order to achieve these and other objects of the invention, an erasing apparatus for a plasma display panel according to one aspect of the present invention includes an erasing signal supplier for supplying an erasing signal taking a ramp waveform shape to any one of first and second electrodes for alternately causing a sustain discharge; and erasure control means for sustaining a voltage of said erasing signal at a voltage upon erasing discharge after the erasing discharge caused by said erasing signal.

In the erasing apparatus, said erasure control means includes a voltage source for generating a voltage; a switch connected between the voltage source and the electrode; and a switch controller for controlling the switch.

Herein, said switch controller reads out pre-stored erasing discharge information and turns off said switch in response to the erasing discharge information, thereby opening a current path between said electrode and said voltage source.

Otherwise, said erasure control means includes a voltage source for generating a voltage; a sensor for sensing said erasing discharge in accordance with a discharge current; a switch connected between the voltage source and the electrode; and a switch controller for controlling the switch in response to a signal from the sensor.

Herein, said switch controller turns off said switch in response to said signal from the sensor to thereby open a current path between said electrode and said voltage source.

The voltage of the erasing signal after the erasing discharge is kept at a voltage lower than a sustain voltage essential to the sustain discharge.

The voltage source generates the sustain voltage.

An erasing method for a plasma display panel according another aspect of the present invention includes the steps of supplying an erasing signal taking a ramp waveform shape to any one of first and second electrodes for alternately causing a sustain discharge; and sustaining a voltage of said erasing signal at a voltage upon erasing discharge after the erasing discharge caused by said erasing signal.

In the erasing method, said step of sustaining said voltage of the erasing signal includes reading out pre-stored erasing discharge information; and opening a current path between an electrode supplied with said erasing signal and a voltage source for generating a voltage in response to the erasing discharge information.

Otherwise, said step of sustaining said voltage of the erasing signal includes sensing said erasing discharge; and opening a current path between an electrode supplied with said erasing signal and a voltage source for generating a voltage in response to the sensed erasing discharge.

The voltage of the erasing signal after the erasing discharge is kept at a voltage lower than a sustain voltage essential to the sustain discharge.

The voltage source generates the sustain voltage.

In a method of driving a plasma display panel having a first row electrode, a second row electrode and a column electrode and having a discharge cell arranged at an intersection among the first row electrode, the second row electrode and the column electrode, and including an erasure period for erasing an emission of the discharge cell, an erasing method for the plasma display panel according to still another aspect of the present invention includes the steps of supplying a ramp erasing pulse to the first row electrode during said erasure period; and supplying a rectangular erasing pulse to the second row electrode in such a manner to overlap with said ramp erasing pulse.

In the erasing method, said rectangular erasing pulse is supplied in a sustain period of said ramp erasing pulse.

Otherwise, said rectangular erasing pulse is supplied in a rising edge of said ramp erasing pulse.

Said rectangular erasing pulse is applied to the second row electrode in the rising edge of said ramp erasing pulse to thereby raise said ramp erasing pulse into a maximum voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
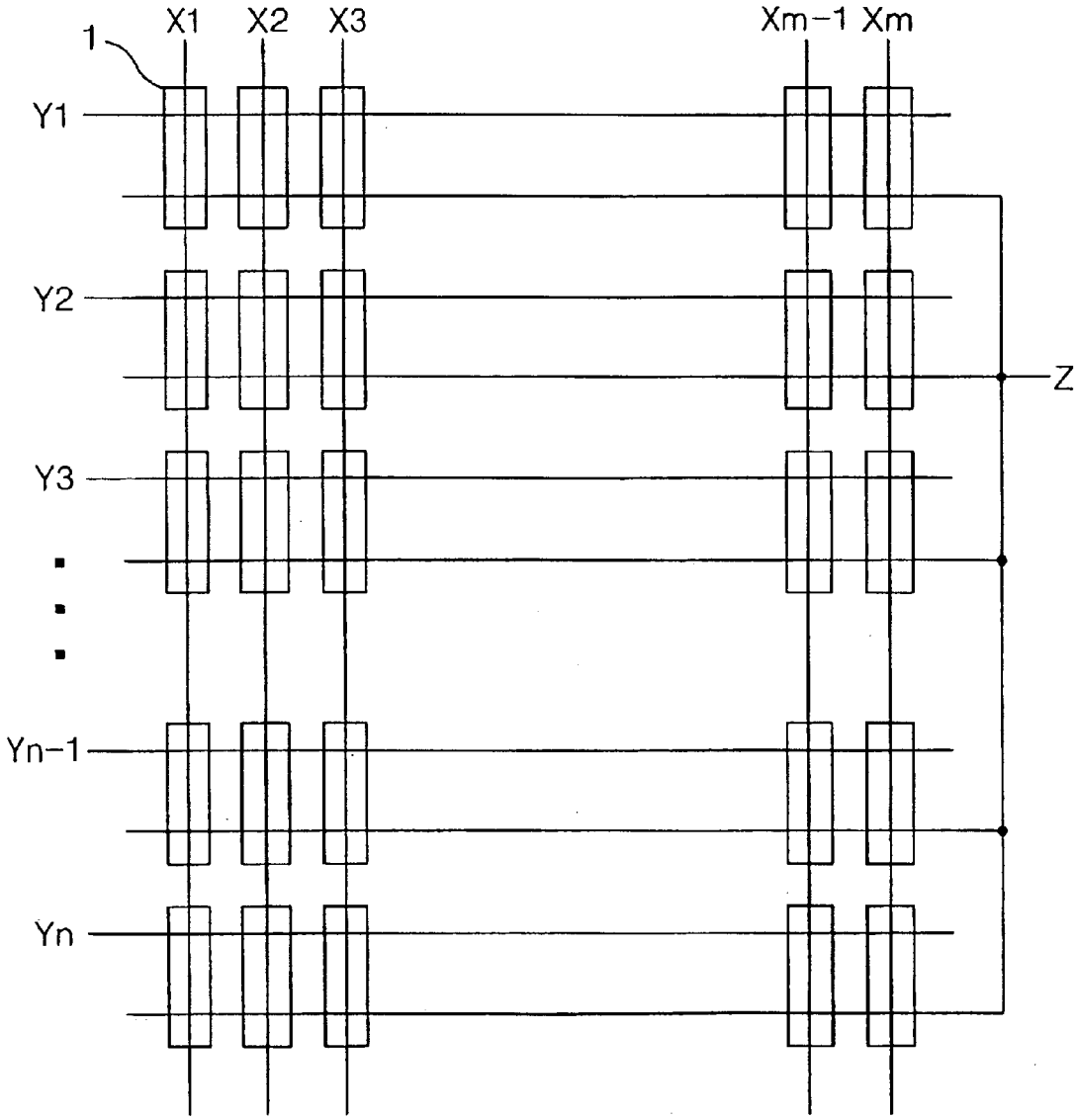
FIG. 1 RELATED ART
FIG. 1 is a plan view showing an electrode arrangement of a conventional three-electrode, AC surface-discharge plasma display panel.
Figure 2:
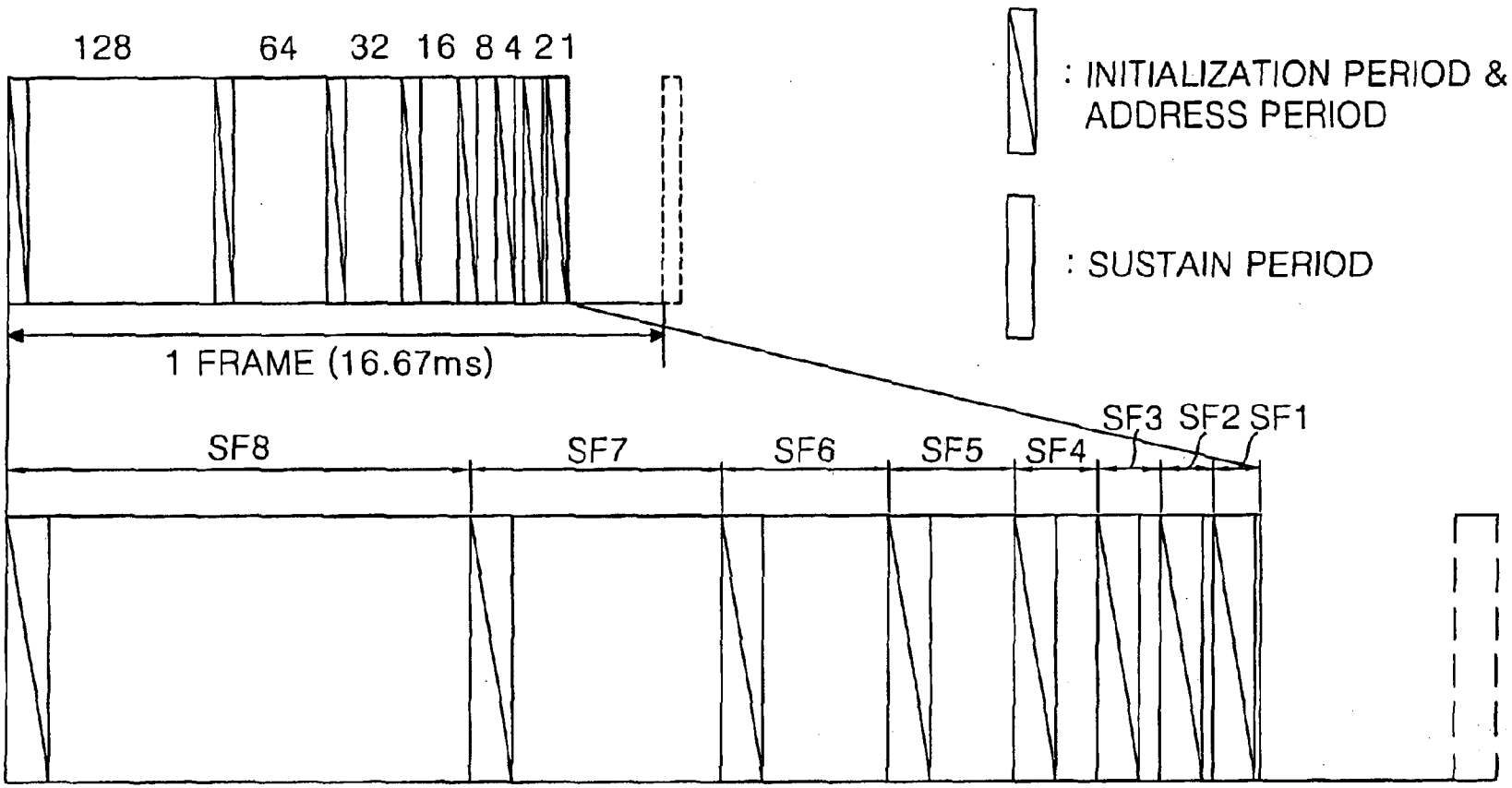
FIG. 2 RELATED ART
FIG. 2 illustrates a frame configuration having 8-bit default codes for implementing 256 gray levels.
Figure 3:
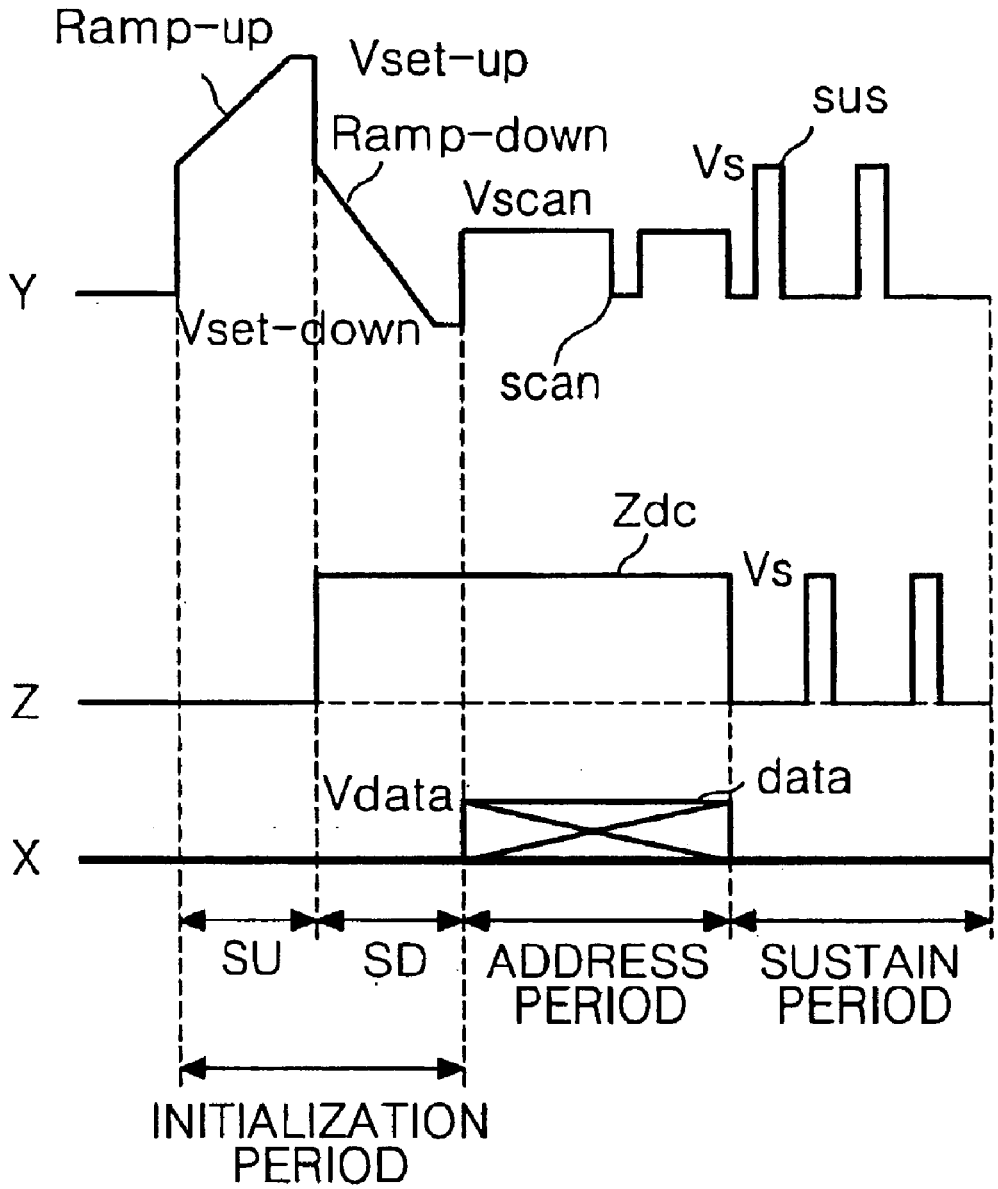
FIG. 3 RELATED ART
FIG. 3 is a waveform diagram of driving signals for driving the conventional plasma display panel.
Figure 4:
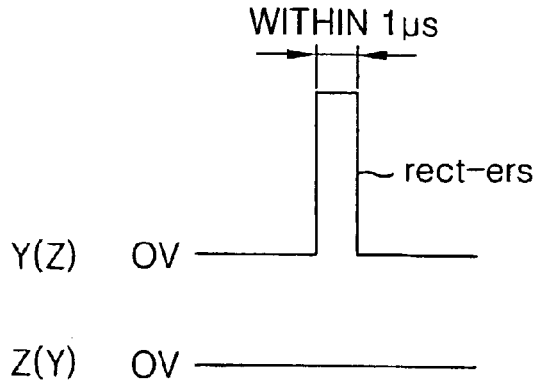
FIG. 4 RELATED ART
FIG. 4 is a waveform diagram of the conventional rectangular fine-width erasing pulse.
Figure 5A:
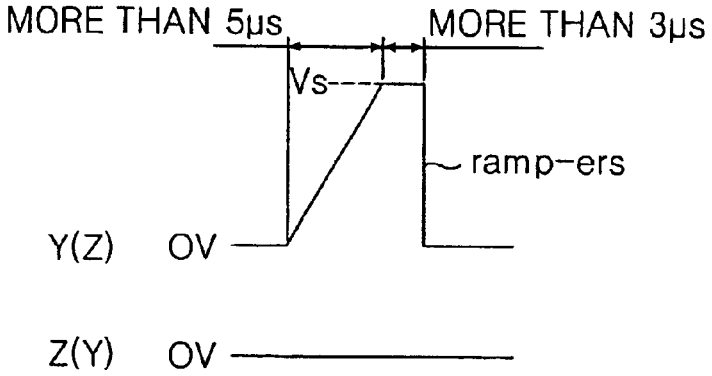
FIG. 5A RELATED ART
FIG. 5A and FIG. 5B are waveform diagrams of the conventional ramp erasing pulses when an erasing discharge does not occur and when an erasing discharge occur, respectively.
Figure 5B:
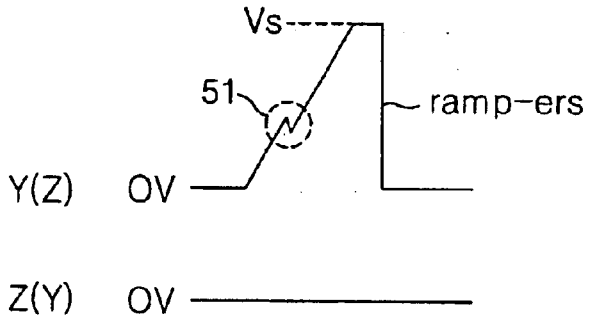
FIG. 5B RELATED ART
Figure 6:
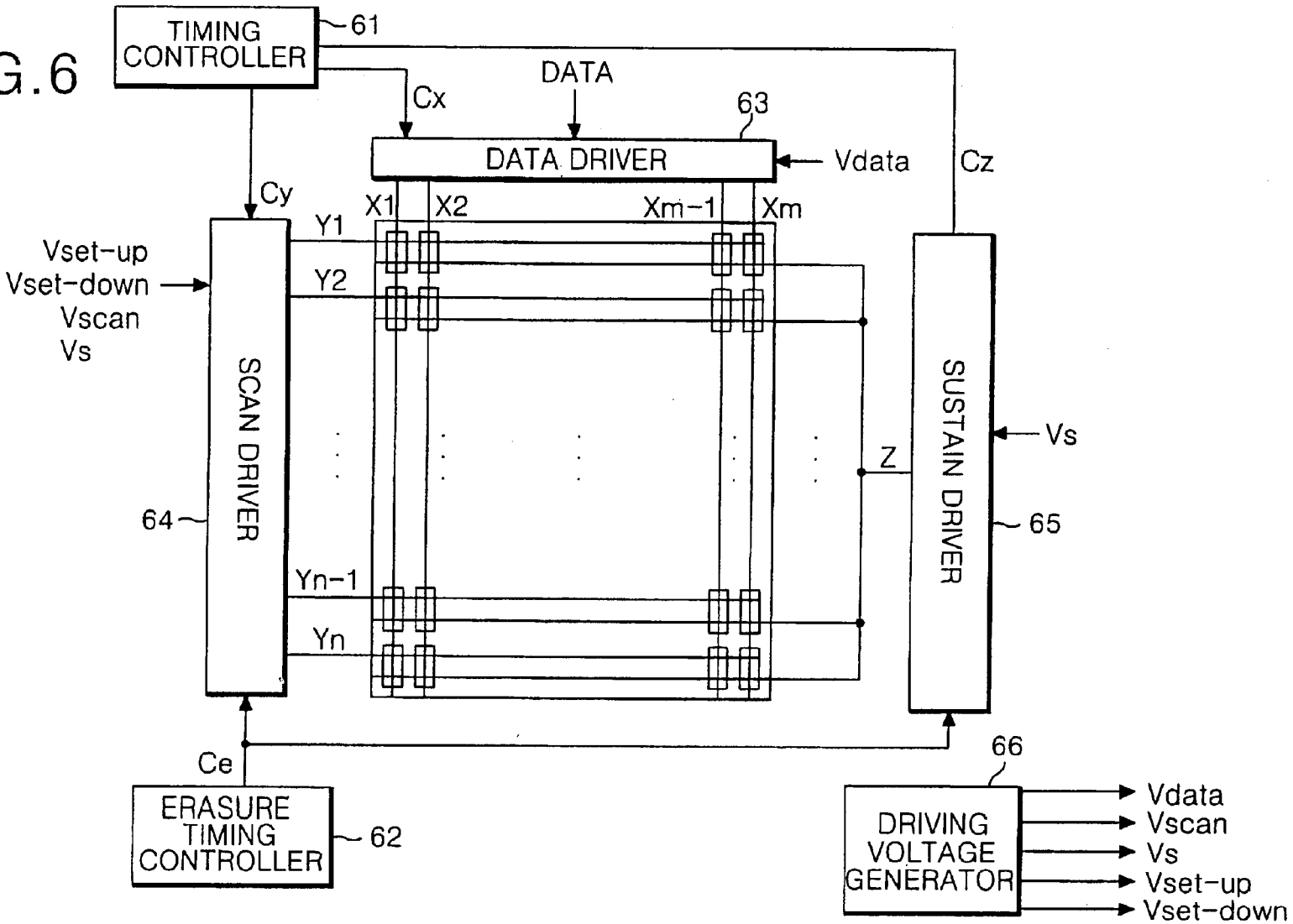
FIG. 6 is a block diagram showing a configuration of a plasma display panel driving apparatus according to a first embodiment of the present invention.
Figure 7:
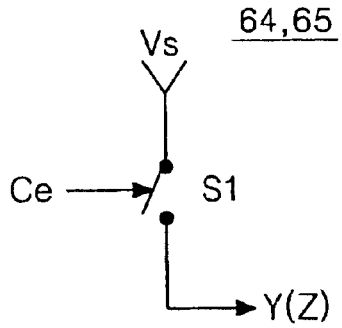
FIG. 7 is a schematic circuit diagram of a switch for generating an erasing signal of the scan driver or the sustain driver shown in FIG. 6.

FIG. 6 shows a driving apparatus for a plasma display panel (PDP) according to a first embodiment of the present invention.

Referring to FIG. 6, the driving apparatus includes a data driver 63 for supplying a data to address electrodes X1 to Xm of the PDP, a scan driver 64 for driving scan electrodes Y1 to Yn of the PDP, a sustain driver 65 for driving a sustain electrode Z which are a common electrode, a timing controller 61 for controlling each of electrode drivers 63 to 65, an erasure timing controller 62 for controlling erasure timing of the scan driver 64 and the sustain driver 65, and a driving voltage generator 66 for generating driving voltages Vdata, Vs, Vset-up and Vset-down.

The data driver 63 is subject to a reverse gamma correction and an error diffusion, etc. by a reverse gamma correcting circuit and an error diffusing circuit, etc. and then applies data mapped by a sub-field mapping circuit for each sub-field to the address electrodes X1 to Xm simultaneously under control of the timing controller 61. Herein, the data voltage Vdata is applied to the address electrodes X1 to Xm selected depending upon a logical value of data inputted to the data driver 63.

The scan driver 64 supplies a ramp-up pulse rising until a set-up voltage Vset-up and a ramp-down pulse falling until a set-down voltage Vset-down in the initialization period or the reset period under control of the timing controller 61 to initialize the cells of the full field. Further, the scan driver 64 sequentially applies a scanning pulse falling from a scan voltage Vscan until a negative set-down voltage Vset-down, or 0V or a ground voltage GND to the scan electrodes Y1 to Yn in the address period, and then simultaneously applies a sustaining pulse rising from 0V or a ground voltage GND until a sustain voltage Vs to the scan electrodes Y1 to Yn during the sustain period.

The sustain driver 65 is alternately operated along with the scan driver 64 to apply a sustaining pulse rising from 0V or a ground voltage GND until the sustain voltage Vs to the sustain electrode Z during the sustain period.

At least one of the scan driver 64 and the sustain driver 65 applies a ramp erasing pulse for causing an erasing discharge to the scan electrodes Y1 to Yn or the sustain electrode Z after a sustain discharge was finished. The ramp erasing pulse generated from the scan driver 64 and the sustain driver 65 keeps a voltage higher than 0V and lower than the sustain voltage Vs after the erasing discharge. In order to generate the ramp erasing pulse, the scan electrode driver 64 and/or the sustain driver 65 includes a switch S1 connected between a sustain voltage source of the driving voltage generator 66 and the scan electrodes Y1 to Yn or the sustain electrode Z. The switch S1 is turned on or off with the aid of an erasure control signal Ce. In the rising edge of the ramp erasing pulse, the switch S1 keeps an ON state to raise a voltage at the scan electrodes Y1 to Yn or the sustain electrode Z, and is turned off in response to the erasure control signal Ce having an inverted logical value when the erasing discharge occurs. During a certain interval extended from a turn-off time of the switch S1, an output of the switch S1 becomes in a floating state. Accordingly, the scan electrodes Y1 to Yn or the sustain electrode Z maintains a voltage at a turn-off time of the switch S1, that is, a time when the erasing discharge occurs. A voltage of the scan electrodes Y1 to Yn or the sustain electrode Z at a time when the erasing discharge has occurred is higher than 0V and lower than the sustain voltage Vs because the erasing discharge of almost cells is generated within the rising edge of the ramp erasing pulse.

Meanwhile, the switch S1 is implemented by at least one MOS-FET device. A rising slope of the ramp erasing pulse is defined by a RC time constant of a resistor R and a capacitor C provided within the scan driver 64 and the sustain driver 65.

The timing controller 61 receives vertical/horizontal synchronizing signals H and V to generate timing control signals Cx, Cy and Cz essential to the electrode drivers 63 to 65, and applies the timing control signals Cx, Cy and Cz to the corresponding drivers 63 to 65.

The erasure timing controller 62 generates an erasure control signal Ce such that the ramp erasing pulse from the scan driver 64 or the sustain driver 65 keeps a voltage lower than the sustain voltage Vs after the erasing discharge to thereby control the scan driver 64 and the sustain driver 65. The erasure timing controller 62 causes several tens of erasing discharge with respect to the PDP, and stores erasing discharge information calculated by an average for a time interval ranged from an initiation time of the ramp erasing pulse until a generation time of the erasing discharge to thereby generate an erasure control signal on the basis of the erasing discharge information. Otherwise, the erasure timing controller 62 may sense a discharge current upon erasing discharge to generate an erasure control signal in response to an erasure sensing signal applied from a sensing circuit (not shown) for detecting an erasing discharge time. Alternatively, the erasure timing controller 62 may be packaged into one chip along with the timing controller 61.

The driving voltage generator 66 generates a data voltage Vdata to apply it to the data driver 63, and generates a scan voltage Vscan, a sustain voltage Vs, a set-up voltage Vset-up and a set-down voltage Vset-down to apply them to the scan driver 64. Further, the driving voltage generator 66 applies the sustain voltage Vs to the sustain driver 65.

Such a present PDP driving apparatus makes a time divisional driving of the PDP while dividing one frame interval into an initialization period for initializing the full field, an address period for selecting the cell and a sustain period for sustaining a discharge of the selected cell.

Figure 8A:
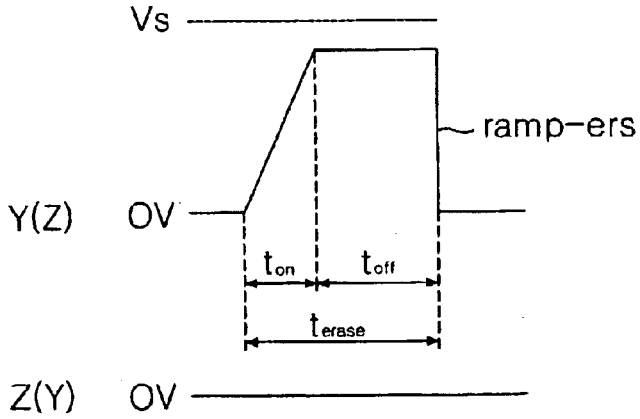
FIG. 8A and FIG. 8B are waveform diagrams of the ramp erasing pulses according to the first embodiment of the present invention when an erasing discharge does not occur and when an erasing discharge occur, respectively.
Figure 8B:
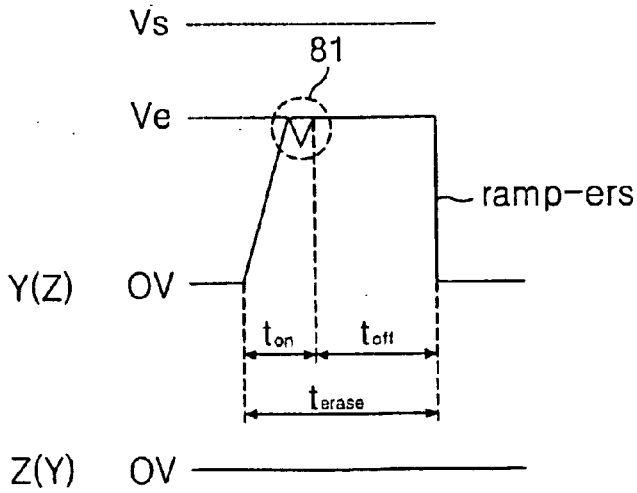

FIG. 8A and FIG. 8B shows a ramp erasing waveform ramp-ers according to the first embodiment of the present invention. More specifically, FIG. 8A represents a ramp erasing pulse ramp-ers when the erasing discharge does not occur while FIG. 8B represents a ramp erasing pulse ramp-ers when the erasing discharge occurs.

Referring to FIG. 8A and FIG. 8B, the ramp erasing pulse ramp-ers is applied to the scan electrodes Y1 to Yn or the sustain electrode Z that is a common electrode, and has a voltage raised during a time interval $t_{on}$ when the switch S1 keeps an ON state. After the erasing discharge, the switch S1 is turned off to keep an erasing discharge voltage Ve lower than the sustain voltage Vs. A reference number '81' shows a voltage drop of the ramp erasing pulse ramp-ers generated due to an erasing discharge current after the erasing discharge. An ON time $t_{on}$ of the switch S1 is approximately more than 2 $\mu$s while an OFF time $t_{off}$ of the switch S1 is approximately more than 5 $\mu$s.

Owing to the ramp erasing pulse ramp-ers, space charges are not converted into wall charges because a voltage Ve applied to the cell after the erasing discharge is low. Accordingly, if the ramp erasing pulse ramp-ers according to the first embodiment of the present invention is applied to the scan electrodes Y1 to Yn or the sustain electrode Z after all the sustain discharge was finished, then it becomes possible to provide a stable erasing discharge, thereby erasing space charges and wall charges generated by the sustain discharge as well as preventing space charges within the cell from being changed into wall charges.

Figure 9:
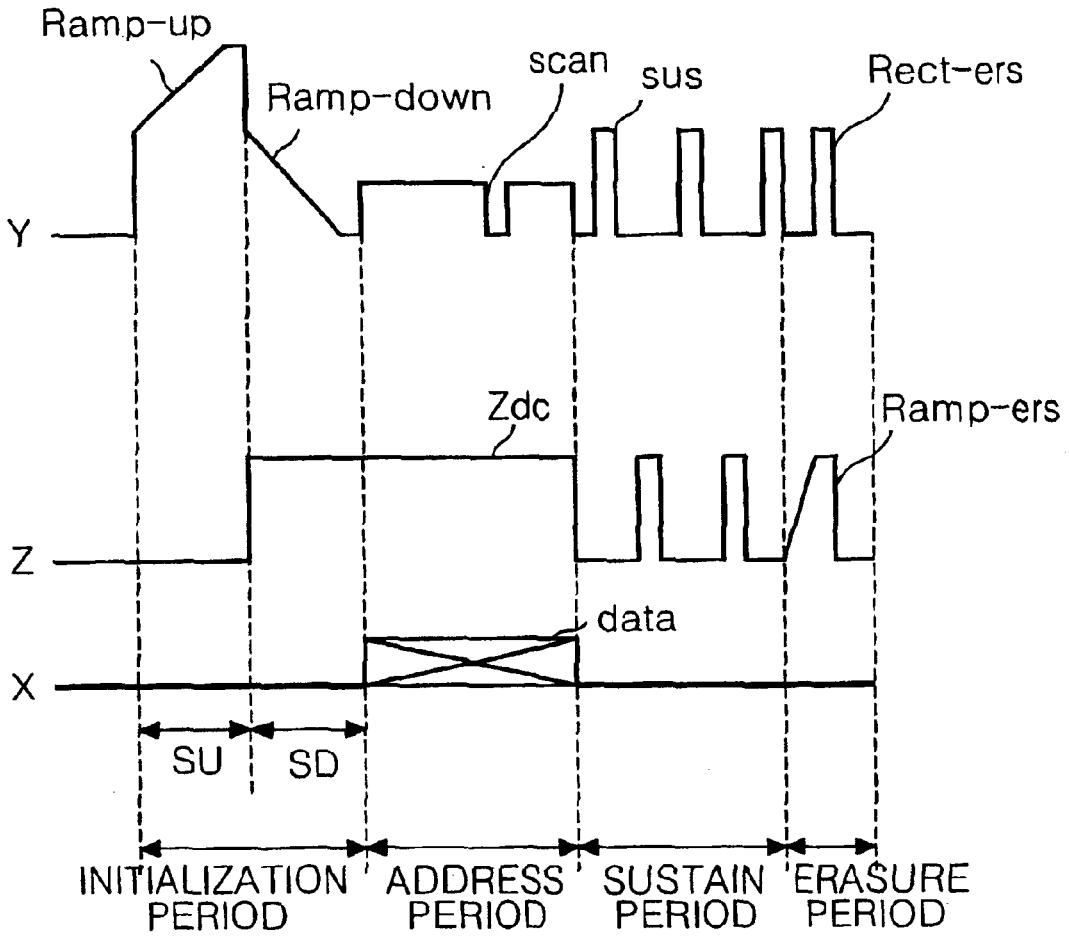
FIG. 9 is a waveform diagram for explaining a method of driving a plasma display panel according to a second embodiment of the present invention.

FIG. 9 is a waveform diagram for explaining a method of driving a plasma display panel according to a second embodiment of the present invention.

Referring to FIG. 9, the PDP is divided into an initialization period for initializing the full field, an address period for selecting a cell, a sustain period for sustaining a discharge of the selected cell, and an erasure period for re-binding wall charges and space charges generated in the sustain period for the purpose of making a time divisional driving thereof.

In the initialization period, a ramp-up pulse Ramp-up is simultaneously applied to all the scan electrodes Y in a set-up interval SU. A discharge is generated within the cells at the full field with the aid of the ramp-up pulse Ramp-up. By this set-up discharge, positive wall charges are accumulated onto the address electrode X and the sustain electrode Z while negative wall charges are accumulated onto the scan electrode Y. In a set-down interval SD, a ramp-down pulse Ramp-down falling from a positive voltage lower than a peak voltage of the ramp-up pulse Ramp-up is simultaneously applied to the scan electrodes Y after the ramp-up pulse Ramp-up was applied. The ramp-down pulse Ramp-down causes a weak erasing discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge. Meanwhile, a positive direct current voltage Zdc is applied to the sustain electrode Z during the set-down interval and the address period.

In the sustain period, a sustaining pulse sus is alternately applied to scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied.

In the erasure period, a ramp erasing pulse Ramp-ers is applied to the sustain electrodes Z and, at the same time, a fine-width erasing pulse Rect-ers is applied to the scan electrodes Y, to thereby erase wall charge and space charges generated in the sustain period.

In other words, the ramp erasing pulse Ramp-ers is applied to the sustain electrodes Z to erase wall charges owing to a fine discharge generated between the sustain electrodes Z and the scan electrodes Y. Further, the fine-width erasing pulse Rect-ers is applied to the scan electrodes Y in such a manner to overlap with the ramp erasing pulse Ramp-ers applied to the sustain electrodes Z by a desired interval, thereby erasing residual wall charges formed within the discharge cell. In this case, positive wall charges are formed at the sustain electrode Z while negative wall charges are formed at the scan electrode Y.

Figure 10A:
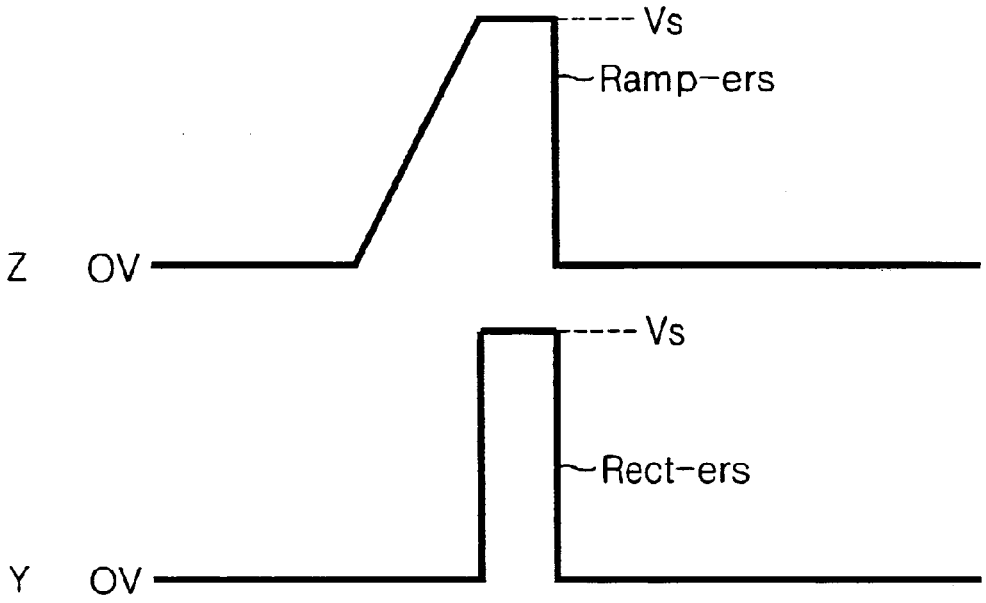
FIG. 10A and FIG. 10B are a detailed waveform diagram of a ramp erasing pulse and a fine-width erasing pulse applied in the erasure period shown in FIG. 9, respectively.

More specifically, if the ramp erasing pulse Ramp-ers is applied to the sustain electrode Z, then a potential difference between the sustain electrode Z and the scan electrode Y is gradually increased, to thereby continuously generate a weak discharge between the sustain electrode Z and the scan electrode Y. At this time, wall charges existing within the cell having generated the sustain discharge are erased owing to a weak discharge generated in the rising edge when the ramp erasing pulse Ramp-ers rises until the sustain voltage Vs. Thereafter, in order to eliminate the residual non-erased wall charges, a fine-width erasing pulse Rect-ers is applied to the scan electrode Y in the sustain period of the ramp erasing pulse Ramp-ers applied to the sustain electrode Z as shown in FIG. 10A, or in the rising edge of the ramp erasing pulse Ramp-ers applied to the sustain electrode Z as shown in FIG. 10B.

Figure 10B:
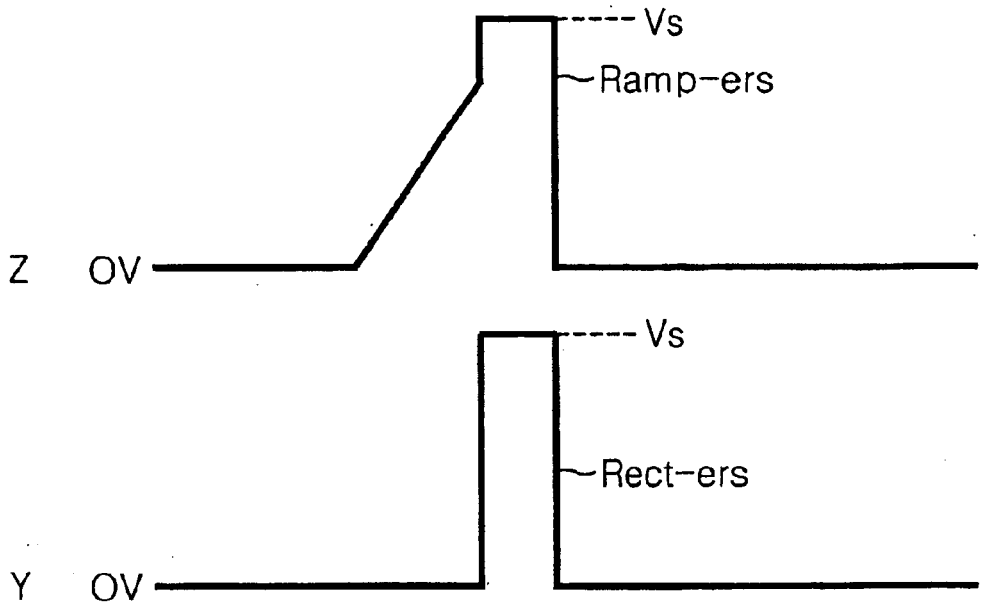

As shown in FIG. 10B, if the fine-width erasing pulse Rect-ers is applied to the scan electrode Y in the rising edge of the ramp erasing pulse Ramp-ers applied to the sustain electrode Z, then the ramp erasing pulse applied to the sustain electrode Z rises instantaneously until a final voltage Vs.

The fine-width erasing pulse Rect-ers applied to the scan electrode Y restrains a formation of wall charges after the erasing discharge, and neutralizes positive wall charges formed on the sustain electrode Z to thereby minimize an amount of wall charges left after the erasing operation. The sustain electrode Z and the scan electrode Y may have a change in an applied pulse shape depending upon positions and polarities of wall charges to be erased.

As described above, according to the present invention, a voltage of the ramp erasing waveform after the erasing discharge is kept to be lower than the sustain voltage. Further, the fine-width erasing pulse is applied to the scan electrode in the sustain period of the ramp erasing pulse applied to the sustain electrode or in such a manner to overlap with the rising edge of the ramp erasing pulse. Accordingly, it becomes possible to minimize spurious wall charges left after the erasing discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An erasing apparatus for a plasma display panel, comprising:

an erasing signal supplier for supplying an erasing signal having a ramp waveform shape to any one of first and second electrodes for alternately causing a sustain discharge; and erasure control means for sustaining a voltage of said erasing signal at a voltage upon erasing discharge after the erasing discharge caused by said erasing signal.

2. The erasing apparatus as claimed in claim 1, wherein said erasure control means includes:

a voltage source for generating a voltage;

a switch connected between the voltage source and the electrode; and a switch controller for controlling the switch.

3. The erasing apparatus as claimed in claim 2, wherein said switch controller reads out pre-stored erasing discharge information and turns off said switch in response to the erasing discharge information, thereby opening a current path between said electrode and said voltage source.

4. The erasing apparatus as claimed in claim 2, wherein said voltage source generates said sustain voltage.

5. The erasing apparatus as claimed in claim 1, wherein said erasure control means includes:

a voltage source for generating a voltage;

a sensor for sensing said erasing discharge in accordance with a discharge current;

a switch connected between the voltage source and the electrode; and a switch controller for controlling the switch in response to a signal from the sensor.

6. The erasing apparatus as claimed in claim 5, wherein said switch controller turns off said switch in response to said signal from the sensor to thereby open a current path between said electrode and said voltage source.

7. The erasing apparatus as claimed in claim 1, wherein said voltage of the erasing signal after the erasing discharge is kept at a voltage lower than a sustain voltage essential to the sustain discharge.

8. The erasing apparatus as claimed in claim 1, wherein the voltage is less than a sustain voltage and greater than zero volts.

9. An erasing method for a plasma display panel, comprising the steps of:

supplying an erasing signal having a ramp waveform shape to any one of first and second electrodes for alternately causing a sustain discharge; and sustaining a voltage of said erasing signal at a voltage upon erasing discharge after the erasing discharge caused by said erasing signal.

10. The erasing method as claimed in claim 9, wherein said step of sustaining said voltage of the erasing signal includes:

reading out pre-stored erasing discharge information; and opening a current path between the electrode supplied with said erasing signal and a voltage source for generating a voltage in response to the erasing discharge information.

11. The erasing method as claimed in claim 10, wherein said voltage source generates said sustain voltage.

12. The erasing method as claimed in claim 9, wherein said step of sustaining said voltage of the erasing signal includes:

sensing said erasing discharge; and opening a current path between the electrode supplied with said erasing signal and a voltage source for generating a voltage in response to the sensed erasing discharge.

13. The erasing method as claimed in claim 9, wherein said voltage of the erasing signal after the erasing discharge is kept at a voltage lower than a sustain voltage essential to the sustain discharge.

14. The erasing method as claimed in claim 9, wherein the voltage is less than a sustain voltage and greater than zero volts.

15. In a method of driving a plasma display panel having a first row electrode, a second row electrode and a column electrode and having a discharge cell arranged at an intersection among the first row electrode, the second row electrode and the column electrode, and including an erasure period for erasing an emission of the discharge cell, an erasing method for the plasma display panel comprising the steps of:

supplying a ramp erasing pulse to the first row electrode during said erasure period; and supplying a rectangular erasing pulse to the second row electrode in such a manner to overlap with said ramp erasing pulse.

16. The erasing method as claimed in claim 15, wherein said rectangular erasing pulse is supplied in a sustain period of said ramp erasing pulse.

17. The erasing method as claimed in claim 15, wherein said rectangular erasing pulse is supplied in a rising edge of said ramp erasing pulse.

18. The erasing method as claimed in claim 17, wherein said rectangular erasing pulse is applied to the second row electrode in the rising edge of said ramp erasing pulse to thereby raise said ramp erasing pulse into a maximum voltage.

19. A plasma display apparatus comprising:

a signal generator to generate a ramp erase signal to an electrode and cause erasing discharge; and a control device to maintain a voltage of the ramp erase signal lower than a sustain voltage based on the erasing discharge.

20. The plasma display apparatus as claimed in claim 19, wherein said control device includes:

a voltage source to generate a voltage;

a switch coupled between the voltage source and the electrode; and a switch controller to control the switch.

21. The erasing apparatus as claimed in claim 20, wherein said switch controller receives erasing discharge information and operates said switch in response to the erasing discharge information, thereby changing a current path between said electrode and said voltage source.

22. The erasing apparatus as claimed in claim 19, wherein said control device includes:

a voltage source to generate a voltage;

a sensor to sense said erasing discharge based on a discharge current;

a switch coupled between the voltage source and the electrode; and a switch controller to control the switch based on a signal from the sensor.

23. The erasing apparatus as claimed in claim 22, wherein said switch controller turns off said switch in response to said signal from the sensor to thereby open a current path between said electrode and said voltage source.

24. The erasing apparatus as claimed in claim 19, wherein said voltage source generates said sustain voltage.

25. The erasing apparatus as claimed in claim 19, wherein the signal generator applies the ramp erase signal after a sustain discharge.

26. The erasing apparatus as claimed in claim 19, wherein the control device maintains the voltage higher than zero volts and lower than a sustain voltage after the erasing discharge.

27. A method of driving a plasma display panel including an erasure period, the method comprising:

supplying a first ramp erasing pulse to a first row electrode during said erasure period; and supplying a second rectangular erasing pulse to a second row electrode in such a manner to overlap with said first ramp erasing pulse.

28. The method as claimed in claim 27, wherein said second rectangular erasing pulse is supplied in a sustain period of said first ramp erasing pulse.

29. The method as claimed in claim 27, wherein said second rectangular erasing pulse is supplied in a rising edge of said first ramp erasing pulse.

30. The method as claimed in claim 29, wherein said second rectangular erasing pulse is applied to the second row electrode in the rising edge of said first ramp erasing pulse to thereby raise said first ramp erasing pulse to a maximum voltage.

* * * * *